US007290374B2

(12) United States Patent
Yoon et al.

(10) Patent No.: US 7,290,374 B2
(45) Date of Patent: Nov. 6, 2007

(54) VIBRATION CONTROL APPARATUS USING WATER TANK LOCATED AT TOP FLOOR OF A TALL BUILDING

(75) Inventors: Sung Won Yoon, Seoul (KR); Young Kyu Ju, Seoul (KR); Dae Kon Kim, Seoul (KR)

(73) Assignee: Seoul National University of Technology, Seoul (KR)

( * ) Notice: Subject to any disclaimer, the term of this patent is extended or adjusted under 35 U.S.C. 154(b) by 486 days.

(21) Appl. No.: 10/791,423

(22) Filed: Mar. 2, 2004

(65) Prior Publication Data

US 2005/0050809 A1 Mar. 10, 2005

(30) Foreign Application Priority Data

Sep. 10, 2003 (KR) ..... 10-2003-0070402

(51) Int. Cl.
*E04H 9/02* (2006.01)
*E04H 9/14* (2006.01)
*F16F 15/023* (2006.01)

(52) U.S. Cl. ..... 52/167.1; 52/168

(58) Field of Classification Search ..... 52/167.1, 52/168, 167.2; 137/357
See application file for complete search history.

(56) References Cited

U.S. PATENT DOCUMENTS 2,134,678 A * 10/1938 Billig et al. ..... 220/563
3,513,797 A * 5/1970 Frankel ..... 114/125
3,658,034 A * 4/1972 Day et al. ..... 119/209
4,663,788 A * 5/1987 Pospisal et al. ..... 5/684
4,783,937 A * 11/1988 Sato ..... 52/168
4,951,441 A * 8/1990 Noji et al. ..... 52/741.1
4,953,330 A * 9/1990 Noji et al. ..... 52/167.2
4,987,710 A * 1/1991 Noji et al. ..... 52/167.2
4,987,711 A * 1/1991 Noji et al. ..... 52/167.2
5,074,086 A * 12/1991 Noji et al. ..... 52/167.2
5,960,981 A * 10/1999 Dodson et al. ..... 220/563

FOREIGN PATENT DOCUMENTS

JP 1-312172 * 12/1989
JP 1-315567 * 12/1989
JP 2-38669 * 2/1990
JP 10-159387 * 6/1998
JP 11-159192 * 6/1999

* cited by examiner

*Primary Examiner*—Robert Canfield
(74) *Attorney, Agent, or Firm*—Hoffmann & Baron, LLP

(57) ABSTRACT

A vibration control apparatus using a water tank, which is installed at the uppermost floor of a tall building, the water tank being formed at the inner wall surface thereof with horizontal protrusions. In order to improve a vibration attenuation rate in a horizontal direction within the water tank, the water tank is installed with vertical wire meshes therein, and the horizontal protrusions serve to improve a vibration attenuation rate in a vertical direction.

2 Claims, 5 Drawing Sheets

VIBRATION CONTROL APPARATUS USING WATER TANK LOCATED AT TOP FLOOR OF A TALL BUILDING

BACKGROUND OF THE INVENTION

1. Field of the Invention

The present invention relates to an apparatus for improving serviceability performance of a tall building by making use of the fluctuation of water contained in a water tank, and more particularly to a vibration control apparatus using a water tank located at top floor of a tall building, which serves to reduce excessive lateral vibration of a tall building, especially, for a slender shaped tall building, due to lateral load caused by wind and seismic activity, thereby preventing residents in the tall building from uncomfortable feeling the tall building shaking.

2. Description of the Related Art

In general, as tall buildings tend to become much lighter and higher, vibration problems due to horizontal load caused by wind and seismic activity are on the increase. If residents in the tall buildings feel severe discomfort due to the vibration of the tall buildings, it is clear that the buildings have severe serviceability problems. Therefore, there have been used various solutions for reducing the vibration of the tall buildings.

Such solutions for satisfying design requirements conforming to a desired serviceability performance of the tall buildings include various kinds of vibration control apparatuses. As examples of such vibration control apparatuses, there are a VED (viscoelastic damper), TMD (tuned mass damper), TLD (tuned liquid damper), base isolator, and the like. Although these vibration control apparatuses can be selectively utilized in consideration of their various merits and shortcomings, in reality, all of them cannot be easily applied to tall buildings since they often require an increase in construction costs thus imposing a heavy burden on the building owners.

Considering the TLD installed in the existing tall buildings, since it is separately provided instead of being directly embodied from a water tank previously installed in the tall buildings, the TLD and the water tank tend to duplicate their installation space and load. On account of this problem, in recent years attempts have been made to directly embody the TLD from the elevated water tank. In this case, however, it is necessary to accurately calculate the damping ratio and the damping force which is dependent on the height vibration variation of water contained in the water tank. Furthermore, the TLD directly embodied from the water tank shows a low vibration control capacity, compared with another conventional TLD, which is separately provided along with the water tank. Therefore, the TLD is limitedly used only when it is desired to slightly improve the serviceability of the tall buildings for wind.

In case of the TLD for use in a tall building, which is developed by Samjung construction located in Japan, it comprises a wire mesh, which is vertically installed in the middle of a water tank so as to secure a desired damping ratio by making use of the horizontal resisting force of fluid contained in the water tank. FIG. 1 illustrates the velocity distribution of a fluid flow in a water tank. In FIG. 1, an horizontal fluid flow shows a maximum velocity at the center of the water tank, and a vertical fluid current shows a maximum velocity at the wall surface of the water tank.

FIG. 2 illustrates an example of the vibration control apparatus using a water tank in accordance with the prior art, which is adapted to increase a damping ratio by installing wire meshes at locations where the maximum velocity occurs. That is, as shown in FIG. 2, the rectangular box shaped water tank, designated as reference numeral 1, comprises a plurality of vertical wire meshes 8 arranged side by side in the middle of the water tank 1, a plurality of horizontal wire meshes 5 stacked in multiple layers at both sides of the vertical wire meshes 8, and a pair of water tank covers 9 covering both sides of the top plane of the water tank 1 above the horizontal wire meshes 5.

The vertical wire meshes 8 are concentrically positioned at the middle of the water tank 1, and the horizontal wire meshes 5 located at both sides of the vertical wire meshes 8 are positioned under water or just above the surface of water, thereby serving to increase the damping force in a vertical direction. It should be noted that the water tank shown in FIG. 2 can achieve an effective damping ratio.

Where the water tank 1 is applied to a tall building, however, the horizontal wire meshes 5 cause a great amount of difficulty in their maintenance. Furthermore, in installation, the vertical wire meshes 8 are vertically fitted from the upper side of the water tank 1, which is already constructed, but in case of the horizontal wire meshes 5, it is hard to fit them inside the water tank 1, and to secure a required support strength of connection regions between the vertical and horizontal wire meshes 8 and 5. In order to achieve the required support strength, additional supports should be installed on the middle of the vertical wire meshes 8.

Furthermore, to the vertical and horizontal wire meshes 8 and 5 of the water tank 1 are attached various kinds of floating particles. In this case, usually, the polluted vertical and horizontal wire meshes 8 and 5 are replaced with new ones instead of removing the floating particles from the vertical and horizontal wire meshes, but the horizontal wire meshes 5 cause a great amount of difficulty in the replacement and reconstruction thereof. Due to this difficulty, the vibration control apparatus, using both the vertical and horizontal wire meshes together, is used as a vibration control apparatus itself, without being used as a water tank, resulting in a problem of additional space being required for the installation of a separate water tank.

SUMMARY OF THE INVENTION

Therefore, the present invention has been made in view of the above problems, and it is an object of the present invention to provide a vibration control apparatus using a water tank located at top floor of a tall building, which can improve vertical resistance of the tall building against vibration by making use of horizontal protrusions formed at the inner wall surface of the water tank, which maximizes the utility of a water tank by allowing the water tank to be variously utilized for controlling horizontal vibration of a tall building and for potable water storage, and which is economical and effective in view of maintenance of vertical wire meshes provided therein.

In accordance with the present invention, the above and other objects can be accomplished by the provision of a vibration control apparatus using a water tank located at top floor of a tall building, comprising: a box shaped water tank having a pair of front and rear walls, a pair of left and right side walls, and a bottom wall; a plurality of vertical wire meshes inserted vertically from upper edges of the front and rear walls and arranged in the middle of the water tank; a plurality of horizontal protrusions formed at an overall inner wall surface of the front and rear walls and left and right side walls while being spaced apart from one another at equal distances, the horizontal protrusions serving to allow passing through a constant amount of fluid contained in the water tank with a damping force; and water tank covers installed at both sides of a top plane of the water tank, the water tank covers being made of reinforced plastic.

Preferably, the respective horizontal protrusions may have a ratio of a vertical width to a thickness of about 1 to 5.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
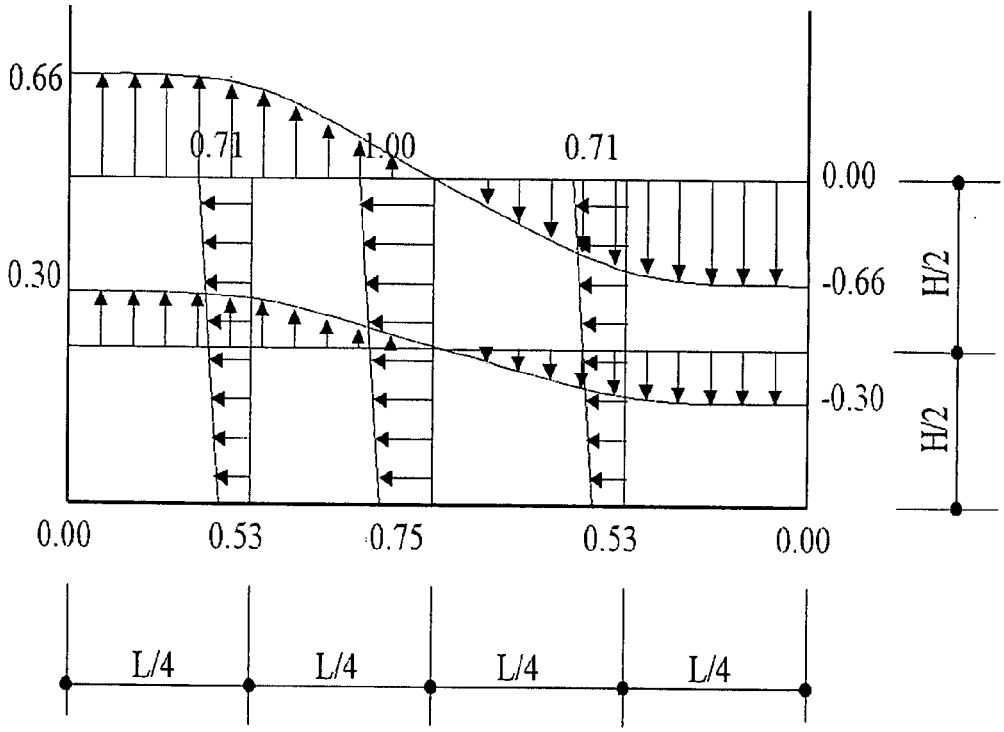
FIG. 1 (Prior Art)
FIG. 1 is a graph illustrating the velocity distribution of fluid contained in a water tank.
Figure 2:
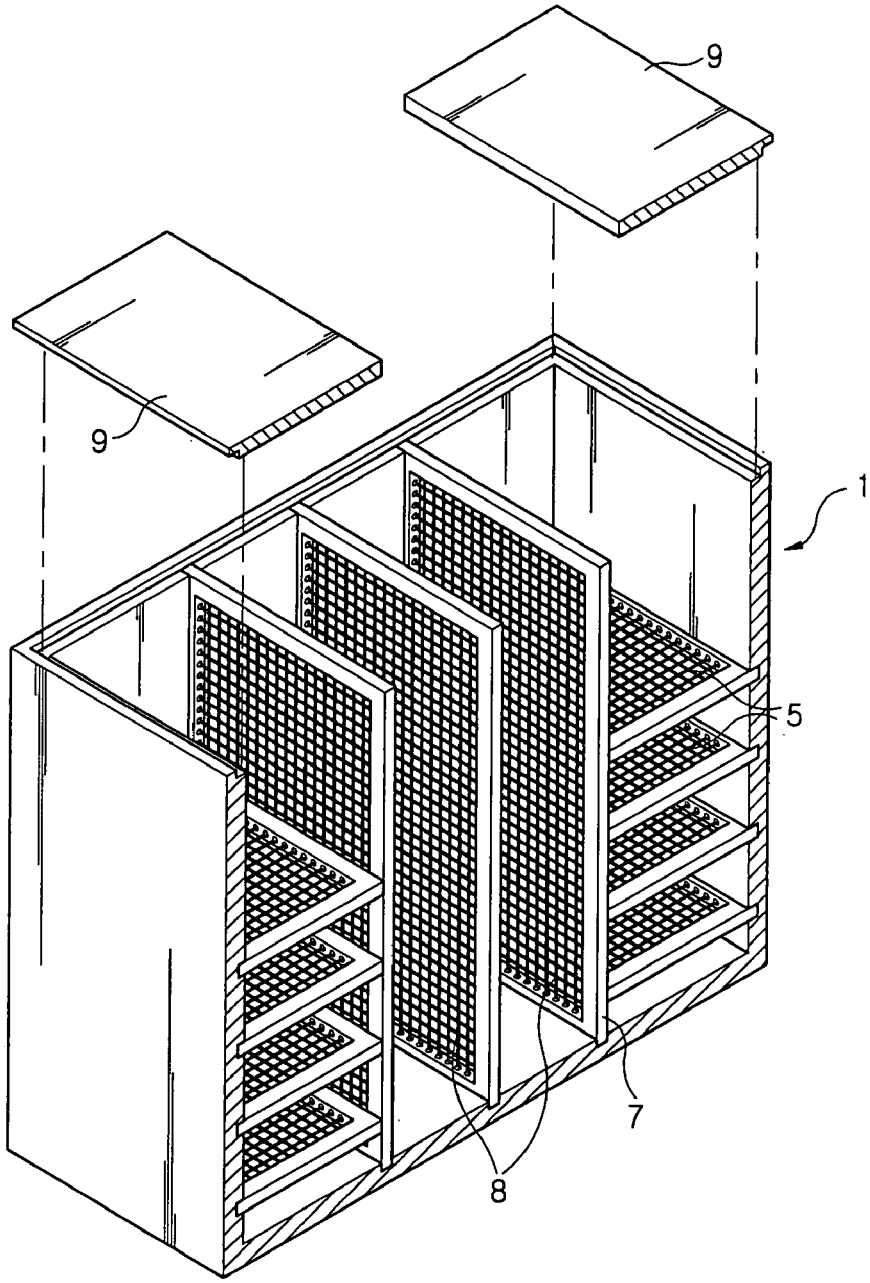
FIG.2 (Prior Art)
FIG. 2 is a perspective view illustrating a vibration control apparatus using a water tank in accordance with the prior art.
Figure 3:
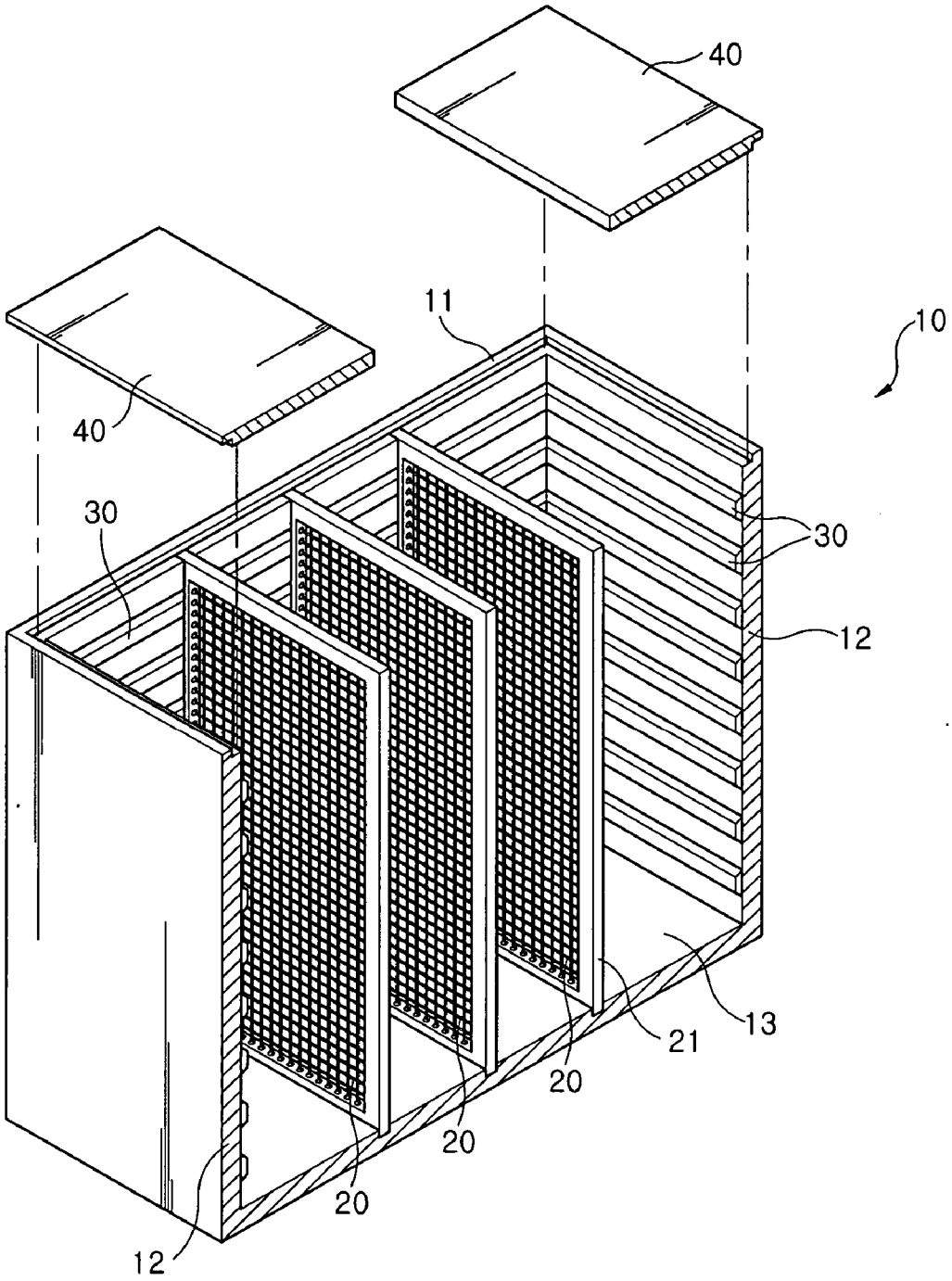
FIG. 3, is a perspective view illustrating a vibration control apparatus using a water tank in accordance with the present invention.
Figure 4:
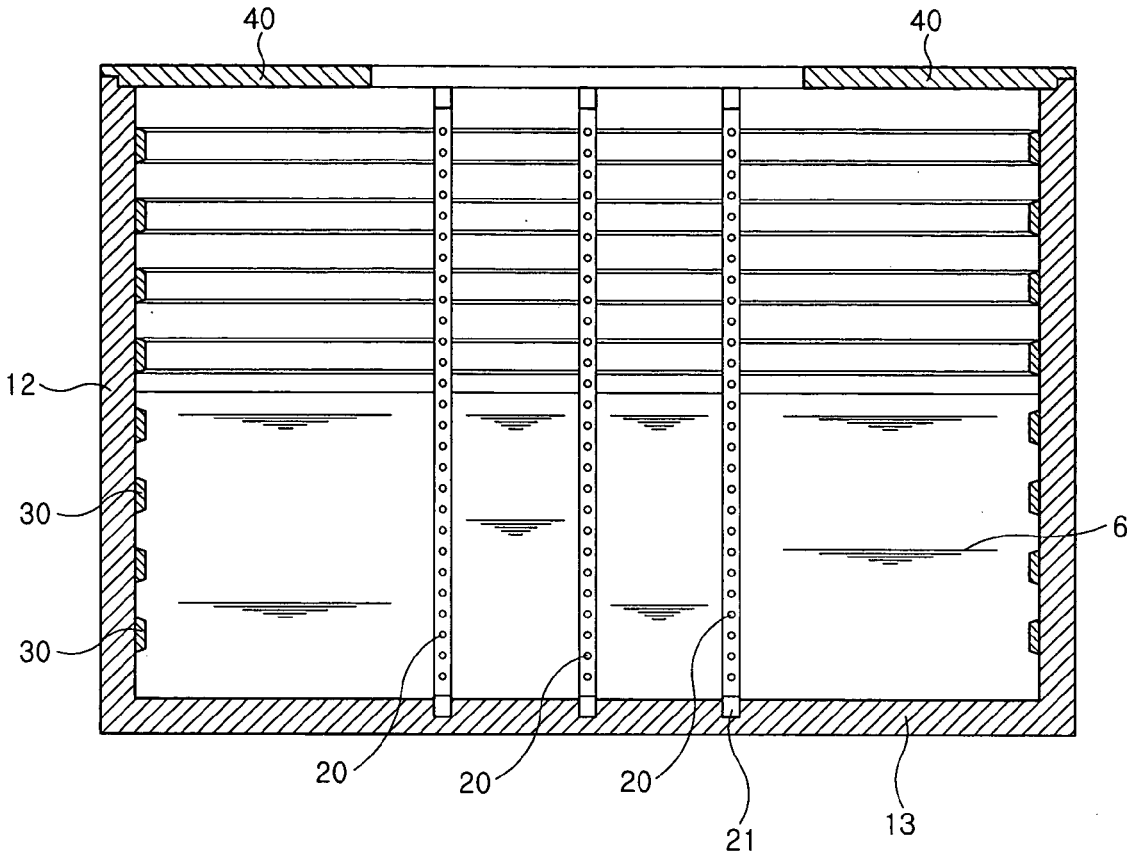
FIG. 4 is a front view of FIG. 3.
Figure 5:
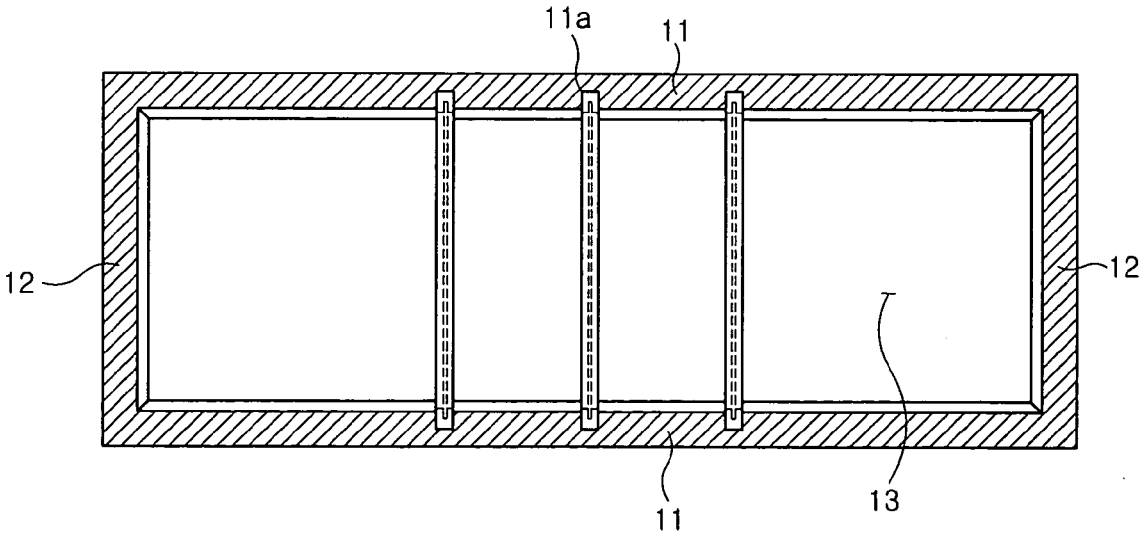
FIG. 5 is a plan view of FIG. 3.

Referring to FIGS. 3 to 6 illustrating a vibration control apparatus in accordance with the present invention, the vibration control apparatus comprises a box shaped water tank 10 consisting of a pair of front and rear walls 11, a pair of left and right side walls 12, and a bottom wall 13. The vibration control apparatus further comprises a plurality of vertical wire meshes 20, which are vertically inserted from the upper edges of the front and rear walls 11 of the water tank 10 so that they are arranged at constant distances in the middle of the water tank 10, and a plurality of horizontal protrusions 30 formed over the inner wall surfaces of both the front and rear walls 11, and left and right side walls 12 while being vertically spaced apart from one another at equal distances. These horizontal protrusions 30 serve to allow passing through a constant amount of fluid 6 filled in the water tank 10 with a desired damping force.

Each of the vertical wire meshes 20 is provided with a frame 21 along the overall perimeter thereof, and the frame 21 is vertically inserted into and fitted in associated elongating vertical grooves 11*a* formed at the front and rear walls 11. At both sides of the top plane of the water tank 10 are installed a pair of water tank covers 40, which are made of reinforced plastic.

The horizontal protrusions 30 have a ratio of thickness to height of about 1 to 5. Further, in order to secure smooth flow of the fluid 6 in a vertical direction by passing the horizontal protrusions 30, the upper and lower edges of the respective horizontal protrusions 30 are inclined by an angle of 60° about a horizontal axis thereof, respectively.

The two water tank covers 40, installed at the top plane of the water tank 10, can be moved in a horizontal direction for securing easy replacement of the vertical wire meshes 20. After being used for a certain period, the vertical wire meshes 20 are incrusted with slime, resulting in a reduction in opening cross sectional area of each mesh. This severely interrupts the flow of the fluid 6, and consequently deteriorates an overall vibration attenuation performance in a horizontal direction, resulting in unexpected problems. Furthermore, in order to allow the fluid 6, such as water, contained in the water tank 10 to be utilized as potable water, the water tank 10 should be cleaned periodically. In this case, the water tank 10 can be cleaned as a worker enters the water tank 10 and cleans it, but the vertical wire meshes 20 are hard to clean thus having to be replaced with new ones. For this, first, the vertical wire meshes 20 are lifted upward and removed from the upper side of the water tank 10. Therefore, the water tank covers 40 installed at the top plane of the water tank 10 are preferably formed in a slidable manner for facilitating the removal of the vertical wire meshes 20. The water tank covers 40 are made of reinforced plastic so as to achieve a desired durability and a reduction in the overall weight thereof. If desired, it is possible to additionally install separate locks on the water tank covers 40, in order to prevent unauthorized persons from accessing the inside of the water tank 10 thus maintaining the fluid 6, such as water, in a clean condition.

The horizontal protrusions 30, formed at the inner wall surface of the water tank 10, extend along the overall horizontal length of the front and rear walls 11 and left and right side walls 12, and are vertically spaced apart from one another at equal distances. These horizontal protrusions 30 serve to enable the nonlinear property of water flowing within the water tank 10 to be accurately estimated. Since the height of water contained in the water tank 10 is variable relative to the height of the water tank 10 in a ratio ranging between 1 to 4 and 1 to 9, the horizontal protrusions 30 have to be formed in a ratio of at least 1 to 3 relative to the height of the water tank 10. In consideration of the manufacturing convenience of a mold for use in the formation of the horizontal protrusions, it is convenient to form the horizontal protrusions 30 over the whole inner wall surface of the water tank 10. Therefore, in principle, the horizontal protrusions 30 are formed over the whole inner wall surface of the water tank 10 while being spaced apart from one another at equal distances, and if necessary, they could be formed in a ratio of 1 to 3 relative to the height of the water tank 10.

Each of the horizontal protrusions 30 has an appropriate vertical width five times as large as its thickness, but the vertical width is variable from three to seven times as large as the thickness. A distance between adjacent ones of the horizontal protrusions 30 corresponds to the vertical width of the horizontal protrusions 30. The upper and lower edges of the respective horizontal protrusions 30 are inclined by an angle of 60° about a horizontal axis thereof, respectively. Such configuration of the horizontal protrusions 30 secures smooth flow of the water contained in the water tank 10 in the vertical direction without severe interruption, and prevents the generation of the counter flow of water, thereby securing a sufficient high vibration attenuation effect.

Figure 6:
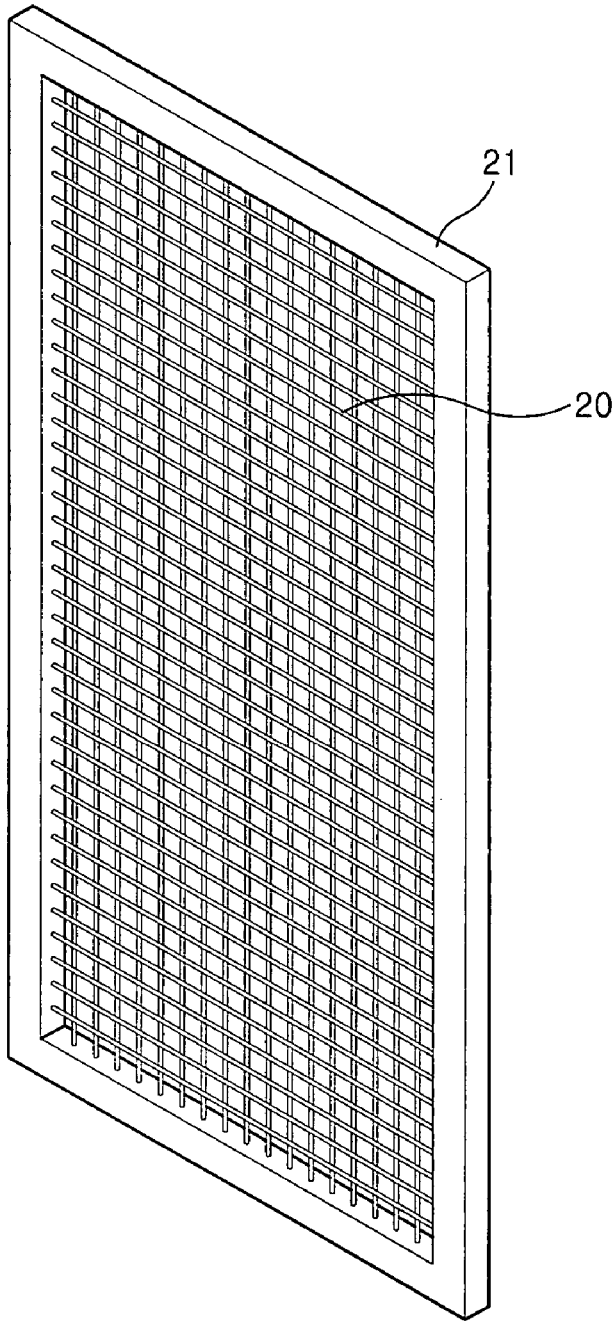
FIG. 6 is a perspective view illustrating a vertical wire mesh installed in the water tank of the present invention.

Referring to FIG. 6 illustrating one of the vertical wire meshes 20 in detail, the vertical wire mesh 20 used in the present invention basically has an aperture ratio of 53.1% and a mesh diameter of 0.3 mm, but the mesh diameter is variable from 0.6 mm to 1.0 mm, and the aperture ratio is variable from 45% to 55%. If the mesh diameter is too small, the vertical wire mesh 20 operates as an obstacle, and on the contrary, if the mesh diameter is too large, it cannot effectively resist the flow of water thus having no function as a vibration attenuation means. The aperture ratio of the vertical wire mesh 20 is a measure indicating the percentage of a water passage space of the cross sectional area of the vertical wire mesh 20. In general, about half of the overall cross sectional area is for the passage of water, and the remaining half is for resistance against the flow of water. If the aperture ratio is too large, the water flows excessively thus causing a low damping, and on the contrary, if the aperture ratio is too small, the water cannot flow smoothly thus causing the vertical wire mesh 20 to function as an obstacle.

The vertical wire mesh 20 and its frame 21 are separately manufactured and coupled to each other, and then inserted along the grooves 11*a* formed at the water tank 10 from the upper side of the water tank 10 after assembling respective wall sections of the water tank 10. The frame 21 and the grooves 11*a* are formed to have a tolerance of 1 mm to 2 mm.

As apparent from the above description, the present invention provides a vibration control apparatus using a water tank located at the top floor of a tall building, which has the following effects:

1) Effective Vibration Control

According to the present invention, the vibration control apparatus could achieve a damping ratio of 2% to 3%. Therefore, it is possible to solve vibration problems of tall buildings due to lateral load caused by wind, and to increase effectiveness of the vibration control apparatus.

2) Reduction of Manufacturing Cost

According to the present invention, it is possible to eliminate the use of horizontal wire meshes, as compared to the prior art. Instead of the conventional horizontal wire meshes, the present invention adopts horizontal protrusions formed at the inner wall surface of the water tank. By virtue of such an integral configuration, the horizontal protrusions can be manufactured with a relatively low cost, and the cost increase is minor. As a result, it is possible to reduce an initial manufacturing cost of the vibration control apparatus.

3) Ease in Maintenance

The wire meshes of the prior art tend to be semi-permanently used after they are installed since it is hard to remove and reinstall thereof. However, in case that the wire meshes are incrusted with slime, this results in a reduction in the aperture ratio thereof as time goes by, the wire meshes inevitably must be replaced with new ones, rather than being cleaned. According to the present invention, by virtue of the slidable upper covers, the replacement of wire meshes is easy. Further, the horizontal protrusions formed at the inner wall surface of the water tank can be simply cleaned when the water tank is cleaned, resulting in a considerable reduction in maintenance cost.

4) Use of Potable Water

In the prior art using a water tank, the water tank is utilized only for the purpose of a vibration control apparatus, but the water tank of the present invention can function as a vibration control apparatus as well as a potable water storage unit. Therefore, it is possible to minimize additional economic burden thereof.

5) Effective Utilization of Space

Conventional techniques need a space for the installation of a vibration control apparatus, resulting in a reduction in the usable area of a building and hence an economic loss. According to the present invention, since the vibration control apparatus utilizes an existing water tank, it is possible to achieve effective and economic use of space, which consequently profits owners of tall buildings.

6) Other Effects

In the prior art, in order to utilize an existing water tank installed in a tall building as a vibration control apparatus, additional loads must be imposed to important structural members of the building and additional space is required. That is, the overall weight of the building increases, resulting in an increase in the sizes of several structural members including columns, walls, beams, and the like, which resist vertical and horizontal loads applied to the building. According to the present invention, however, since there is no additional weight increase, the vibration control apparatus of the present invention has no effect on existing building design. Preferably, the present invention improves vibration resistance performance in a horizontal direction of the building and contributes a reduction in the overall weight of the building.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vibration control apparatus using a water tank located at top floor of a tall building, comprising:

a box shaped water tank having a pair of front and rear walls, a pair of left and right side walls, and a bottom wall;

a plurality of vertical wire meshes inserted vertically from upper edges of the front and rear walls and arranged in the middle of the water tank;

a plurality of horizontal protrusions formed at an overall inner wall surface of the front and rear walls and left and right side walls while being spaced apart from one another at equal distances, the horizontal protrusions serving to allow passing through a constant amount of fluid contained in the water tank with a damping force; and water tank covers installed at both sides of a top plane of the water tank, the water tank covers being made of reinforced plastic, wherein the respective horizontal protrusions have a ratio of a vertical width to a thickness of about 1 to 5 and the respective horizontal protrusions have upper and lower edges, which are inclined by an angle of 60° about a horizontal axis thereof, respectively, in order to secure smooth flow of the fluid in a vertical direction.

2. The apparatus as set forth in claim 1, wherein the vertical wire meshes have a mesh diameter in a range between 0.6 mm and 1.0 mm, and an aperture ratio in a range between 45% and 55%.

* * * * *